US011034366B2

(12) United States Patent
Erharter

(10) Patent No.: US 11,034,366 B2
(45) Date of Patent: Jun. 15, 2021

(54) ROLLER ASSEMBLY DEVICE OR A TROLLEY DEVICE FOR A CABLE TRANSPORTATION SYSTEM

(71) Applicant: Leitner S.P.A., Vipiteno (IT)

(72) Inventor: Nikolaus Erharter, San Candido (IT)

(73) Assignee: Leitner S.P.A., Vipiteno (IT)

( * ) Notice: Subject to any disclaimer, the term of this patent is extended or adjusted under 35 U.S.C. 154(b) by 317 days.

(21) Appl. No.: 16/096,439

(22) PCT Filed: Apr. 28, 2017

(86) PCT No.: PCT/IB2017/052490
§ 371 (c)(1),
(2) Date: Oct. 25, 2018

(87) PCT Pub. No.: WO2017/187415
PCT Pub. Date: Nov. 2, 2017

(65) Prior Publication Data

US 2020/0324796 A1 Oct. 15, 2020

(30) Foreign Application Priority Data

Apr. 29, 2016 (IT) ..... 102016000044289

(51) Int. Cl.
*B61B 12/02* (2006.01)
*B61B 11/00* (2006.01)
(Continued)

(52) U.S. Cl.
CPC ..... *B61B 12/02* (2013.01); *B61B 11/00* (2013.01); *B61B 12/026* (2013.01); *B61B 12/002* (2013.01); *B61B 12/06* (2013.01)

(58) Field of Classification Search
CPC ..... B61B 12/02; B61B 12/04; B61B 12/022; B61B 12/024; B61B 12/026;
(Continued)

(56) References Cited

U.S. PATENT DOCUMENTS 4,462,314 A * 7/1984 Kunczynski ..... B61B 7/04 104/115
4,864,937 A * 9/1989 Kunczynski ..... B61B 7/04 104/173.1
7,398,958 B1 * 7/2008 Michel ..... B61B 12/04 104/112

FOREIGN PATENT DOCUMENTS

CN 202098414 1/2012
CN 202783194 3/2013
(Continued)

OTHER PUBLICATIONS

Notification of the Recording of a Change for International Application No. PCT/IB2017/052490 dated Jan. 30, 2018.
(Continued)

*Primary Examiner* — Zachary L Kuhfuss
*Assistant Examiner* — Cheng Lin
(74) *Attorney, Agent, or Firm* — Neal, Gerber & Eisenberg LLP

(57) ABSTRACT

A device of a roller assembly or a trolley for a cable transportation system, the device comprising: a frame having two facing walls, which are provided with two respective first holes having a first axis in common; a pin that engages the first holes; a body mounted rotatably about the pin between the two facing walls of the frame, the body having a hole, which has a second axis and enables the passage of the pin; and an auxiliary constraining device that is selectively releasable configured to keep the axes of the first holes of the frame and of the hole of the body coincident even in the absence of the pin.

18 Claims, 3 Drawing Sheets

(51) Int. Cl.
*B61B 12/00* (2006.01)
*B61B 12/06* (2006.01)

(58) Field of Classification Search
CPC ..... B61B 12/028; B61B 12/002; B61B 11/00; B61B 11/002; B62D 55/14; B62D 55/15
USPC ..... 104/173.2
See application file for complete search history.

(56) References Cited

FOREIGN PATENT DOCUMENTS

| | | | | |
|---|---|---|---|---|
| EP | 0187552 | A1 * | 7/1986 | ..... B61B 12/122 |
| FR | 1423648 | | 1/1966 | |
| FR | 2744974 | A1 * | 8/1997 | ..... B61B 12/02 |
| FR | 2838697 | A1 * | 10/2003 | ..... B61B 12/06 |
| FR | 2926275 | A1 * | 7/2009 | ..... B61B 12/122 |
| WO | WO 2016/012929 | | 1/2016 | |

OTHER PUBLICATIONS

Notification Concerning Submission, Obtention or Transmittal of Priority Document for International Application No. PCT/IB2017/052490 dated Aug. 14, 2017.
International Search Report and Written Opinion for International Application No. PCT/IB2017/052490 dated Nov. 9, 2017.
Chinese Office Action from Chinese Application No. 201780025465.4, dated Dec. 3, 2019 (5 pages).

* cited by examiner

ROLLER ASSEMBLY DEVICE OR A TROLLEY DEVICE FOR A CABLE TRANSPORTATION SYSTEM

PRIORITY CLAIM

This application is a national stage application of PCT/IB2017/052490, filed on Apr. 28, 2017, which claims the benefit of and priority to Italian Patent Application No. 102016000044289, filed on Apr. 29, 2016, the entire contents of which are each incorporated by reference herein.

TECHNICAL FIELD

The present disclosure relates to a roller assembly device or a trolley device for a cable transportation system. In particular, the present disclosure relates to a device for a cable transportation system that can be installed in either roller assemblies or cable trolleys. The device according to the present disclosure comprises a frame and a body that is rotatable about a pin with respect to the frame. For example, the body that is rotatable about the frame may be a rocker arm configured to support a haul cable.

The present disclosure also relates to a method for the maintenance of a roller assembly device or a trolley device for a cable transportation system.

BACKGROUND

In cable transportation systems, such as chair-lifts or gondola-lifts, the respective chairs or cabins are moved forward by a haul cable that is taken up and let out by respective pulleys along a path defined by a series of supporting pylons.

Roller assemblies may be mounted on the top of the pylons to support the haul cable. Each roller assembly is equipped with one or more rocker arms, provided with a plurality of rollers, the purpose of which is to support and guide the haul cable.

In the cable transportation systems using cableway trolleys, the latter move along the path defined by the cables supporting a cabin.

The role of the rocker arms in both of these structures is crucial because they make sure the load on all the rollers of the roller assemblies is equal and balanced. To achieve this objective, the rocker arms are rotatably coupled to the corresponding frame by pins and bushings.

For safety reasons, these pins and bushings, which are subject to wear, must be inspected regularly.

These periodic maintenance operations are relatively very expensive, because such components are difficult to access, especially the roller assemblies of the cable supports. Consider that the use of helicopters is often, if not always, necessary in order to remove the roller assembly from the pylon.

In any case, the maintenance of the roller assemblies as described above and the maintenance of the cableway trolleys that is performed in the station both currently disadvantageously require the dismantling of the entire structure to remove the pins and/or the bushings to inspect and, if necessary, replace them.

SUMMARY

Starting from said method known in the prior art, a purpose of the present disclosure is to implement a roller assembly device or a trolley device for a cable transportation system that enables the pins and/or the respective bushings to be removed and replaced without having to dismantle the corresponding roller assembly, or trolley.

In accordance with the present disclosure, there is provided a roller assembly device or a trolley device for a cable transportation system comprising: a frame having two facing walls, the walls having two respective first holes with a first axis in common; a pin that engages the first holes of the frame; a body, for instance a rocker arm, mounted rotatably about the pin between the two facing walls of the frame, the body having a hole which has a second axis for the passage of the pin; and an auxiliary constraining device configured to keep the first and second axes coincident even in the absence of the pin. In this way, the roller assembly or the trolley can be arranged so that both the pin and the auxiliary constraint device act independently to keep the axes of the first holes of the frame and of the hole of the body coincident. In this configuration, the pin and the respective bushings can be removed safely by extracting them from the roller assembly or trolley structure, upon which the auxiliary constraint device acts to keep the axes of the first holes of the frame and of the hole of the body coincident even in the absence of the pin. Therefore, advantageously, there is no longer any need to dismantle the components, body and frame, which, during the normal use of the roller assembly or trolley are supported by the pin, which must be removed, checked and, if necessary, replaced. Since the correct alignment of the axes is guaranteed even in the absence of the pin, after performing the necessary checks, the same pin and/or the bushings, or a new pin and/or new bushings, can be inserted to restore the correct operation of the roller assembly or of the trolley simply by inserting it in the respective seat.

In particular, the auxiliary constraining device configured to keep the axes of the first holes of the frame and of the hole of the body coincident even in the absence of the pin may comprise two rings internally attached to the walls of the frame in correspondence with the first holes. Said rings externally overlap a portion of the ends of a sleeve of the body that houses the pin. Radial holes are formed in said rings in a position that is freely accessible for the insertion of screws, that, once tightened, hold the body by securing the body to the frame in the same position as when the pin is present. In this way, the screws simply have to be tightened to hold the body in position in relation to the frame even in the absence of the pin.

In particular, the rings have at least three radial holes equally spaced around the rings. In this way precision adjustments can be made to ensure the correct alignment of the axes.

In particular the rings are attached to the walls in a releasable manner. In this way the initial assembly of the roller assembly or trolley and/or the replacement of the body housed between the inner walls of the frame can be performed relatively easily.

Additional features are described in, and will be apparent from the following Detailed Description and the figures.

BRIEF DESCRIPTION OF THE DRAWINGS

Further features and advantages of the present disclosure will appear clear from the following description of a non-limiting embodiment thereof, with reference to the figures in the accompanying drawings, in which.

DETAILED DESCRIPTION

Figure 1:
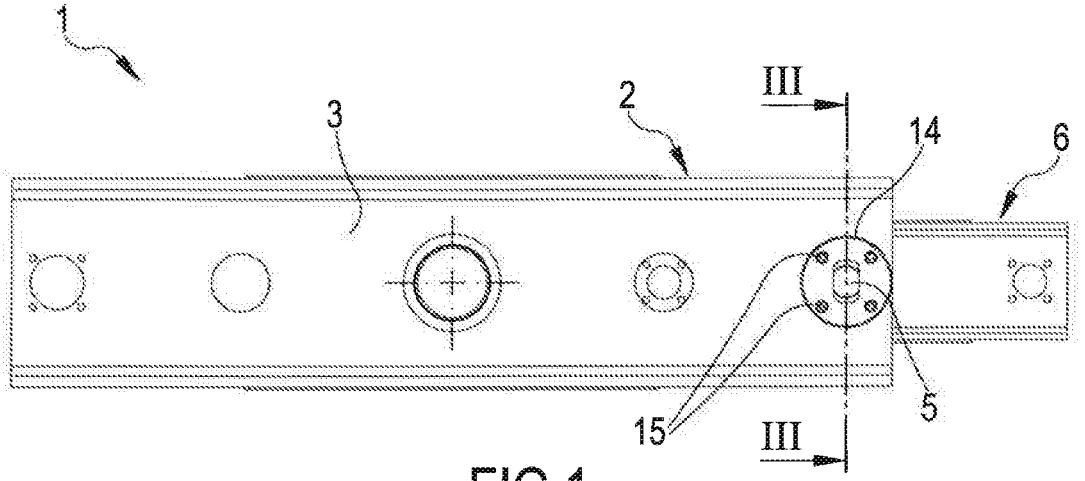
FIG. 1 is a side view of an example of a roller assembly device or a trolley device for a cable transportation system implemented in accordance with the present disclosure.
Figure 7:
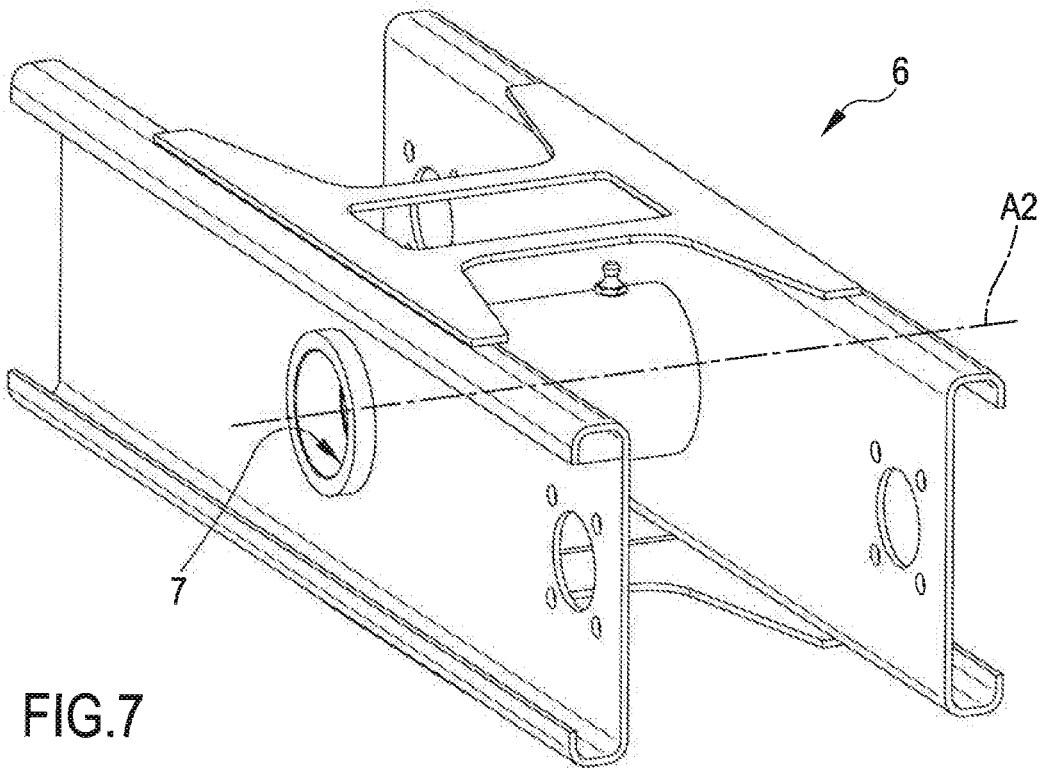

Referring now to the example embodiments of the present disclosure illustrated in FIGS. 1 and 7, reference number 1 indicates a roller assembly device or a trolley device for a cable transportation system implemented in accordance with the present disclosure.

Specifically, device 1 comprises:

- a frame 2 comprising two facing walls 3, the walls 3 having two respective first holes 4 with a first axis A1 in common;
- a pin 5 that engages the first holes 4;
- a body 6 mounted rotatably about the pin 5 between the two facing walls 3 of the frame 2, wherein the body 6 is provided with a hole 7 having a second axis A2 for the passage of the pin 5.

Figure 5:
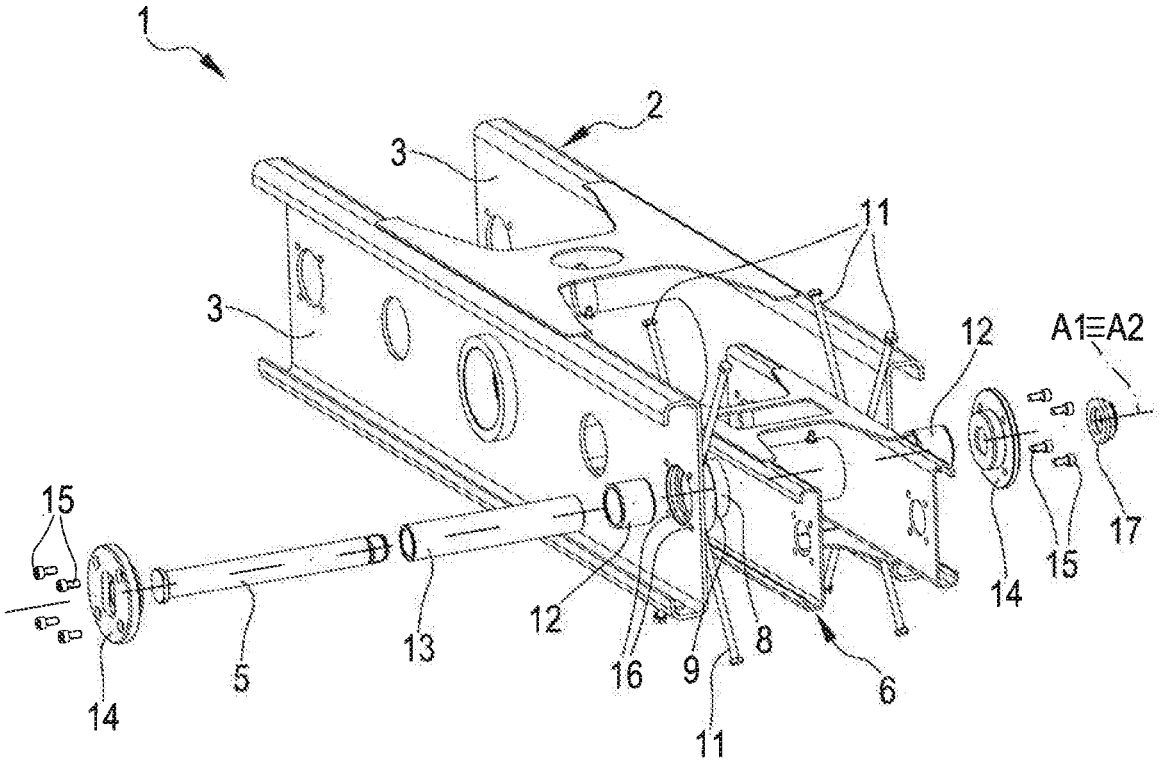
FIG. 5 is a perspective view of the device in FIG. 1 where even in the absence of the pin the axes of the frame and of the body housed therein are kept coincident.
Figure 6:
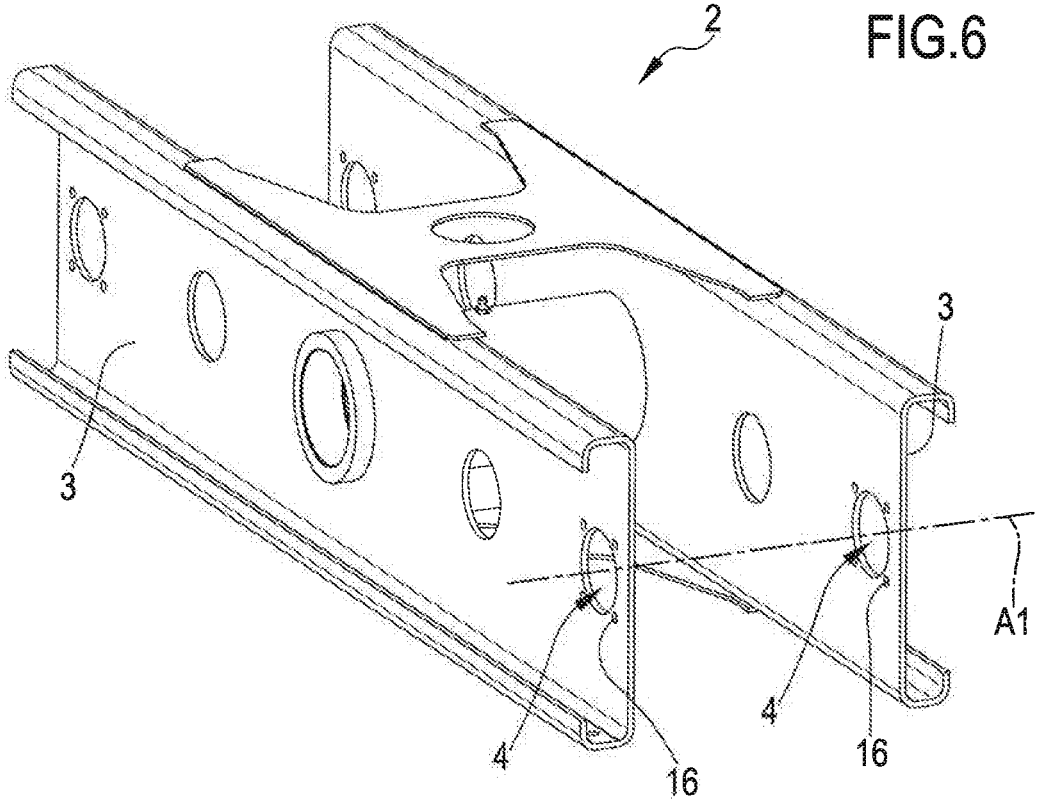
FIGS. 6 and 7 show some components of the device of FIG. 1 uncoupled from one another.

FIGS. 5 and 6 show separate embodiments of the frame 2 and of the body 6 where the frame is a chassis of a trolley for a cable transportation system and the body 6 is a rocker arm to support the rollers.

However, for the purposes of the present disclosure, the term "body" does not refer exclusively to a rocker arm, but more generally to any revolving support that can be used in a cable transportation system or even an actual roller.

During the normal use of the device 1 installed on a roller assembly or on a trolley, the pin 5 rotatably constrains the body 6 with respect to the frame 2 so that the axis A2 of the body 6 and the axis A1 of the holes 4 of the frame are coincident with each other and with the axis of the pin 5.

According to the disclosure, the device 1 comprises a selectively releasable auxiliary constraining device configured to keep the axes A1, A2 of the first holes 4 of the frame 2 and of the hole 7 of the body 6 coincident even in the absence of the pin 5. In other words, starting from the correct alignment of the axes A1 and A2 guaranteed by the common pin 5, said auxiliary device "freezes" said alignment of the two axes so that this does not depend on the physical presence of the pin 5, which can thus be pulled out and removed, replaced with a new one, if necessary, and then put back in its seat.

According to the example shown in the Figures, the body 6 comprises a sleeve 8 configured to house the pin 5 and the auxiliary device configured to keep the axes A1, A2 coincident even in the absence of the pin 5 comprises two rings 9 internally attached to the facing walls 3 of the frame 2 in correspondence with the first holes 4. These two rings 9 protrude from the walls 3 by an amount such as to externally overlap the sleeve 8 for a portion of the ends thereof.

In correspondence with said portion in which the rings 9 overlap the sleeve 8, the rings 9 have radial holes 10, such as threaded holes, facing the sleeve 8 which accommodate screw elements 11.

Figure 2:
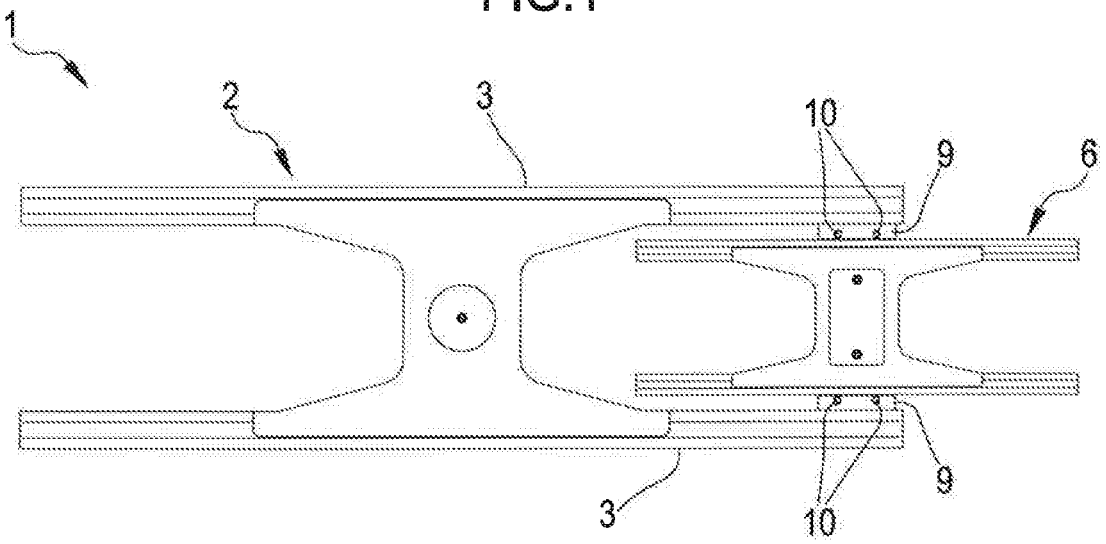
FIG. 2 is a view from above of the device in FIG. 1.
Figure 4:
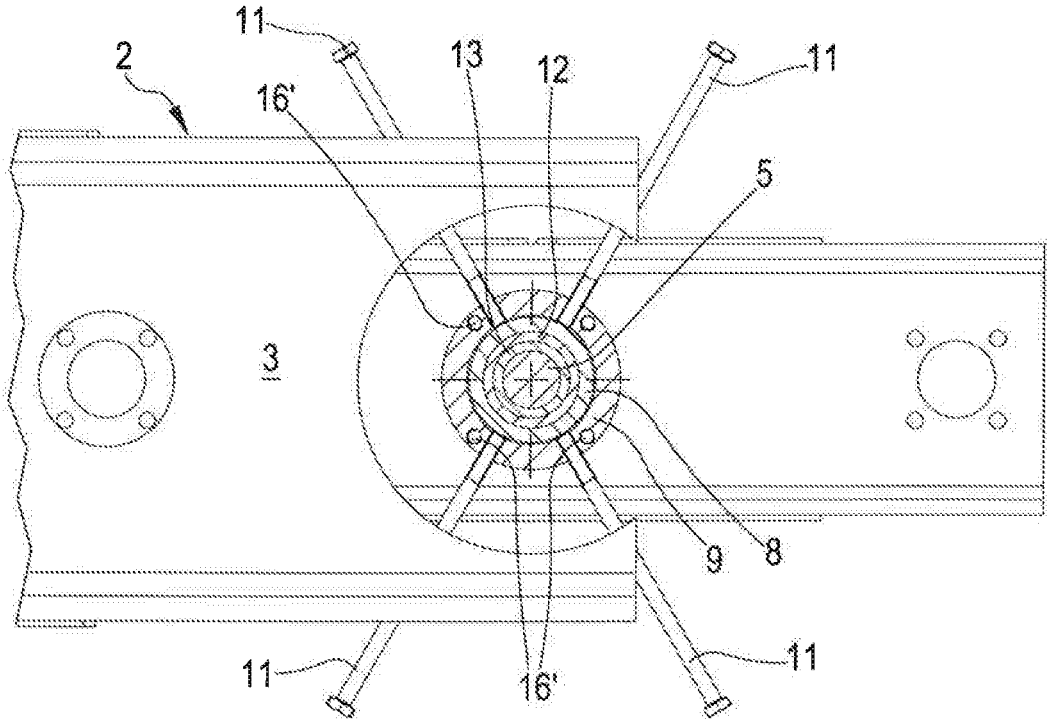
FIG. 4 is a partially split view of the device of FIG. 1 in a configuration ready for the extraction of the pin.

As shown in FIG. 2, the holes 10 are in a freely accessible position so that the operator can relatively easily insert the corresponding screws as required. In FIGS. 4 and 5, the screws 11 are shown with an exaggerated length purely for the sake of clarity.

The rings 9 may be formed as a single piece with the walls 3 of the frame 2 or may be removable, for example fastened to the walls 3 by screw elements (not shown).

In certain embodiments, each ring 9 comprises at least three radial holes equally spaced from each other. In the non-limiting example shown in the Figures each ring 9 comprises four radial holes 10 arranged at 90° in relation to one another.

The device 1 may comprise a pair of lateral bushings 12 interposed between the end portions of the sleeve 8 and the pin 5.

Furthermore, the device 1 may comprise an additional internal bushing 13 that extends the entire length of the sleeve 8 and is interposed between the lateral bushings 12 and the pin 5.

During the use of the roller assembly or of the trolley with the device 1, the holes 4 of the walls 3 of the frame 2 are capped by two bored flanges 14 configured to house the ends of the pin 5. Said flanges 14 are fixed to the frame 2 in a removable manner by screws 15 inserted in holes 16 formed in the walls 3 around the holes 4. The flange 14 attached to the head of the pin 5 has a slotted recess to accommodate the widened head of the pin 5, while on the opposite side the other flange 14 is attached to a cap 17 to prevent the penetration of water or impurities. The portions of the flanges 14 inside the holes 4 pack the assembly consisting of the bushings 12, 13, the pin 5 and the sleeve 8.

The lateral bushings 12 are held in place on one side by the flanges 14 and on the other side by the ledges 18 formed on the inside of the sleeve 8.

As shown in FIG. 4, the rings 9 also have holes 16' aligned with holes 16 formed in the fastening walls 3 of the flanges 14. In this way, the fastening screws 15 of the flanges 14 also fasten the rings 9 to the walls 3.

If the rings 9 are formed as a single piece with the walls 3 of the frame 2, the holes 16' are the internal extension of external holes 16 configured to fasten the flanges 14.

It is relatively easy to understand the functioning of the device 1 of a roller assembly or of a trolley for a cable transportation system in accordance with the present disclosure, where the auxiliary constraint device is configured to keep the axes A1, A2 of the first holes 4 of the frame 2 and of the hole 7 of the body 6 coincident even in the absence of the pin 5. Said auxiliary constraint device thus achieves a new and inventive method for the maintenance of a roller assembly or a trolley for a cable transportation system. In particular, the method refers to the maintenance of the pin 5 and/or of the bushings 12, 13 of the roller assembly or of the trolley comprising the device 1.

Figure 3:
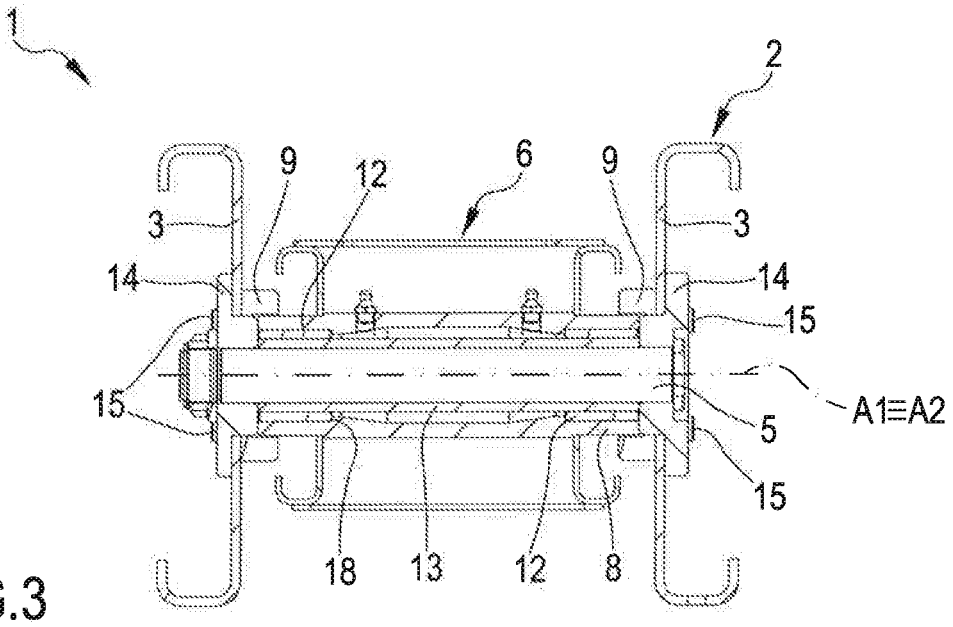
FIG. 3 is a section view of the device of FIG. 1 along the lines of section III-III.

During normal use, the device 1 of the roller assembly or of the trolley is in the configuration shown in the section in FIG. 3, where the axes A1, A2 of the first holes 4 of the frame 2 and of the hole 7 of the body 6 are kept aligned by the physical presence of the pin 5.

In order to remove the pin 5, according to the present disclosure, a constraint is established between the body 6 and the frame 2 while the pin 5 is still engaged in the holes 4 of the frame 2 and in the hole 7 of the body 6.

Said constraint is achieved by activating an auxiliary device which selectively locks the body 6 and the frame 2 together by acting externally with respect to the pin 5. In particular the auxiliary constraint device is activated by inserting and tightening the screws 11 in the holes 10 of the rings 9.

As shown in FIG. 2, the holes 10 are freely accessible so that the screws 11 can be inserted with relative ease.

Once the screws 11 have been tightened, two independent constraining devices act simultaneously on the device 1, both of which are configured to keep the axes A1, A2 of the first holes 4 of frame 2 and of the hole 7 of the body 6 coincident.

The first constraining device is the pin 5, while the second constraining device consists in the auxiliary constraint device comprising the rings 9 and the screws 11 that lock the body 6 and the frame 2 together acting externally with respect to the pin 5.

Starting from said dual-constraint configuration, it is thus possible to act in safety on the screws 15 of the flanges 14 and thus extract the pin 5, and/or the respective bushings 12, 13, from the first holes 4 of the frame 2 and from the hole 7 of the body 6.

As shown in FIG. 5, based on the rings 9 being fitted on the sleeve 8 and to the screws 11, the hole 7 of the body 6 remains with the axis A2 aligned with the axis A1 of the holes 4 of the frame 2 even in the absence of the pin 5. Thus the pin 5 can be removed without having to dismantle the roller assembly or the trolley 1.

The removal of the flanges 14, which is necessary to extract the pin 5, may be performed in steps. First, one flange 14 is removed and the screws 15 are screwed back into the wall 3 so that they also engage the holes 16' of the corresponding ring 9 and then the same operations are repeated on the second flange 14.

Once the flanges 14 have been removed, the pin 5 and/or the respective bushings 12, 13 can be extracted by translation, in order to carry out all the necessary tests on said components to check whether the same pin 5 can still be used or needs to be replaced with a new pin 5.

Once these checks have been performed, a pin 5, which could be the "old" pin 5 that has been inspected or a "new" pin 5, can be inserted into the first holes 4 of the frame 2 and into the hole 7 of the body 6 based on the auxiliary constraint device having kept the respective axes A1 and A2 coincident even in the absence of the pin 5.

After inserting the pin 5 and repositioning the flanges 14, the device 1 is once again subject to the dual constraint, that is, the constraint exerted by the pin 5 and by the auxiliary device, to keep the axes A1 and A2 of the first holes 4 of the frame 2 and of the hole 7 of the body 6 coincident.

In this safety condition the screws 11 can therefore be removed to restore the device 1 to the original condition in which the body 6 is mounted rotatably about the pin 5 between the walls of the frame 2.

It is clear that changes and variations may be made to the roller assembly device or trolley device for a cable transportation system described herein, without departing from the scope of protection of the appended claims. As such, the present disclosure also covers embodiments not described in the detailed description and equivalent embodiments that fall within scope of the appended claims. Accordingly, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A cable transportation system device comprising:

a frame comprising two facing walls respectively defining two first holes, wherein the two first holes have a common first axis;

a pin that extends through the two first holes;

a body rotatably mounted about the pin between the two facing walls of the frame, the body comprising a sleeve configured to house the pin and the body defining a hole which the pin extends through and which has a second axis; and an auxiliary device comprising a first ring constrained to a first of the two facing walls of the frame in correspondence with the first hole of that facing wall, the first ring projecting from the first of the two facing walls to externally overlap a portion of a first end of the sleeve, and a second ring constrained to a second of the two facing walls of the frame in correspondence with the first hole of that facing wall, the second ring projecting from the second of the two facing walls to externally overlap a portion of a second, opposite end of the sleeve, wherein the auxiliary device is configured to keep the first axis and the second axis coincident independent of the pin.

2. The cable transportation system device of claim 1, wherein the auxiliary device comprises a plurality of screws configured to be screwed into a plurality of radial holes defined by the first and second rings to adjust a position of the body.

3. The cable transportation system device of claim 2, wherein the first ring is releasably constrained to the first one of the two facing walls and the second ring is releasably constrained to the second one of the two facing walls.

4. The cable transportation system device of claim 2, wherein the radial holes of the first and second rings are in a freely accessible position.

5. The cable transportation system device of claim 2, wherein the first ring and the second ring each define at least three radial threaded holes.

6. The cable transportation system device of claim 5, wherein for each of the first and the second ring, the radial threaded holes are equally spaced around that ring.

7. The cable transportation system device of claim 1, further comprising a pair of lateral bushings interposed between the portions of the ends of the sleeve and the pin.

8. The cable transportation system device of claim 7, further comprising an internal bushing which extends for an entire length of the sleeve and is interposed between the pair of lateral bushings.

9. The cable transportation system device of claim 8, further comprising two flanges releasably fixed to an outer surface of the frame at locations corresponding to the first holes in the two facing walls of the frame.

10. The cable transportation system device of claim 9, wherein a plurality of flange fastening holes are defined by the two facing walls and extend inside the first and second rings.

11. The cable transportation system device of claim 1, wherein the cable transportation system device comprises one of: a cable transportation system roller assembly device and a cable transportation system trolley device.

12. A method of maintaining a cable transportation system device including a frame comprising two facing walls respectively defining two first holes, wherein the two first holes have a common first axis, a first pin that extends through the two first holes, and a body rotatably mounted about the first pin between the two facing walls of the frame, the body defining a hole which the first pin extends through and which has a second axis, the method comprising:

establishing, in the presence of the first pin, a constraint between the body and the frame by an auxiliary constraint device internally attached to the two facing walls of the frame in correspondence with the two first holes, wherein the establishment of the constraint between the body and the frame comprises:

providing two rings internally attached to the two facing walls of the frame in correspondence with the two first holes, and a sleeve portion of the body configured to house the first pin, wherein the two first rings protrude from the two facing walls to externally overlap respective portions of the ends of the sleeve, and screwing a plurality of screws into a plurality of radial holes defined by the two rings corresponding with an area the two rings overlap with the sleeve to adjust a position of the body, and while the auxiliary constraint device is internally attached to the two facing walls of the frame in correspondence with the two first holes, extracting the first pin from the two first holes of the two facing walls of the frame and from the hole of the body.

13. The method of claim 12, further comprising:

while the auxiliary constraint device is internally attached to the two facing walls of the frame in correspondence with the two first holes, inserting a second, different pin into the two first holes of the two facing walls of the frame and into the hole of the body; and releasing the auxiliary constraining device after the second, different pin extends through the two first holes of the two facing walls of the frame and through the hole of the body.

14. The method of claim 13, wherein inserting the second, different pin further comprises:

inserting the second, different pin by translation into the two first holes of the two facing walls of the frame and into the hole of the body, and attaching two flanges to an outer surface of the frame at locations corresponding to the two first holes of the two facing walls.

15. The method of claim 12, further comprising releasing the auxiliary constraining device by removing the plurality of screws from the radial holes defined by the two rings.

16. The method of claim 12, wherein extracting the first pin from the two first holes of the two facing walls of the frame and from the hole of the body comprises:

removing two flanges releasably attached to an outer surface of the frame at locations corresponding to the two first holes of the two facing walls, and extracting the first pin by translation from the two first holes of the two facing walls of the frame and from the hole of the body.

17. The method of claim 12, further comprising:

while the auxiliary constraint device is internally attached to the two facing walls of the frame in correspondence with the two first holes, reinserting the first pin into the two first holes of the two facing walls of the frame and into the hole of the body; and releasing the auxiliary constraining device after the first pin extends through the two first holes of the two facing walls of the frame and through the hole of the body.

18. The method of claim 17, wherein reinserting the first pin further comprises:

reinserting the first pin by translation into the two first holes of the two facing walls of the frame and into the hole of the body, and attaching two flanges to an outer surface of the frame at locations corresponding to the two first holes of the two facing walls.

* * * * *